US005296270A

United States Patent [19]

Prosser

[11] Patent Number: 5,296,270

[45] Date of Patent: Mar. 22, 1994

[54] PROCESS FOR MAKING A THERMALLY RADIANT SURFACE

[75] Inventor: Paul L. Prosser, Chapin, S.C.

[73] Assignee: Custom Training Aids, Inc., Swansea, S.C.

[21] Appl. No.: 755,622

[22] Filed: Sep. 5, 1991

[51] Int. Cl.[5] ..... B05D 3/06

[52] U.S. Cl. ..... 427/448; 427/455

[58] Field of Search ..... 427/448, 449, 455, 564, 427/580

[56] References Cited

U.S. PATENT DOCUMENTS

| | | | |
|---|---|---|---|
| 3,791,863 | 2/1974 | Quirk | 427/123 |
| 4,078,097 | 3/1978 | Miller | 427/449 |
| 4,134,004 | 1/1979 | Anderson et al. | 439/347 |
| 4,263,341 | 4/1981 | Martyniak | 427/449 |
| 5,133,126 | 7/1992 | Matsuoka | 427/455 |

FOREIGN PATENT DOCUMENTS

| | | | |
|---|---|---|---|
| 9229727 | 12/1984 | Japan | 427/448 |
| 86/06241 | 10/1986 | PCT Int'l Appl. | 427/448 |

OTHER PUBLICATIONS

Field Manual No. 25-7, "Training Ranges", excerpts: Preface, pp. 8-10 Dept. of Army; Wash. D.C. Sep. 16, 1985.

Albert Guy, *Elements & Physical Metallurgy*, pp. 259-262, 2nd ed. Addison-Wesley Publ. Co., Inc., Reading, Mass., Jul. 1960.

Plastic Engineers, vol. 38, No. 4 Apr. 1982 (Reprint) Paper prepared by Merle Thorpe.

Finle, D. Electronic Engineers'Handbook McGraw Hill 1975 Section 6.

Ser. No. 7/579,619 "Thermal Integrated Targets" by Paul Prosser Sep. 10, 1990.

*Primary Examiner*—Marianne Padgett

*Attorney, Agent, or Firm*—F. Rhett Brockington

[57] ABSTRACT

A process for producing electrically conductive surfaces on infrared emitting military targets, wherein the electrically conductive surfaces, when electrified, heat up and produce an infrared image on the face of the target, where the process accommodates imperfections inherent in the structural components of the target, said target being substantially constructed of relatively inexpensive coarse materials, such as strand board; wherein the process consists of building up pattern designs of multiple thin layers of an arc-sprayed zinc having an unusually high resistivity, until the pattern designs attain a resistance and wattage that will have a uniform desired surface temperature throughout the pattern design, said design producing a realistic signature infrared image.

5 Claims, 2 Drawing Sheets

PROCESS FOR MAKING A THERMALLY RADIANT SURFACE

BACKGROUND OF THE INVENTION

The invention is generally related to the art of electrically resistive heating elements, and more particularly to the process art of creating an electrically resistive heating element on a structural element, such that the surface of the structural element heats and radiates infrared energy.

The invention employs the use of an arc-sprayer, in a series of steps, to create a resistive electrical component, wherein the resistive component is generally supported by a structural element, such that when the resistive component is carrying an electric current, it heats producing a thermally radiant surface. Arc-sprayers are commonly used in the manufacture of casting molds to line the inner walls of the casting mold with a metal, which greatly improves the durability of the mold. An arc-sprayer produces an atomized metal spray by liquefying a continuously fed metal wire in an electric arc and then atomizing the molten metal with a pressurized stream of gas, which throttles out into a prescribed spray pattern. Arc-sprayers are reported to be the method of choice for applying a purely metal coating to plastic materials such as ABS, vinyl, polypropylene and urethanes; because an arc-sprayer, in comparison to a torch-sprayer, produces a relatively cooler spray. In general, the metals that are used with an arc-sprayer are selected for the properties they impart to the casting mold. In decorative applications, such as bronzing a statue, color can predominate. In order to be suitable for application via an arc-sprayer the metal must be conductive, however, the conductivity of the applied coating is usually not a consideration in selecting a preferred metal, as durability or color requisites dominate. Zinc, and alloys of zinc such as Kirksite, and copper are often the metals of choice. Arc-spayed zinc has been reported to be suitable for producing EMI shields for co-axial cable, and computer and video cabinets. Copper, which of course is a very common conductor, is only about 3.6 times more conductive than zinc. Copper forms a hotter spray than zinc, and has been used less frequently on plastics for EMI shields. Zinc at $5.92\times10^{-6}$ ohm cm has a volume resistivity that is about 20 times that of nichrome, which is commonly used for wire heating elements, while zinc is generally considered too conductive to be used for heating elements.

In the instant invention, arc-sprayed zinc, applied in a series of process steps, has been found to be suitable for producing large dimensioned, low voltage heating elements. Further, the volume resistivity for the zinc in these heating elements is about one hundred times higher than is expected, which has unanticipated benefits. The heating elements are formed as an integral functional component of the targets. The targets are used in combination with infrared detectors, to practice detection, recognition and destruction of military targets, which are usually equipment and personnel. The heating elements are designed to simulate the thermal image signatory of the real-life versions. Infrared emitting targets must meet a number of criteria to optimize their utility, and the instant invention is amenable to creating thermal images on widely differing target sizes, shapes and performance characteristics.

The surface of the target must emit a quantity of heat that imitates real life equipment and personnel. A temperature 15–50 degrees Fahrenheit above ambient is usually sought. The surface must attain this temperature in a matter of seconds after the target is activated. The size, shape and distribution of the irradiating thermal image must mimic the real life counterpart. The cost of construction of the total target must be relatively inexpensive, as destruction is the ultimate goal. The target must have good weatherability as it will be used outdoors. In is very important that the target be capable of withstanding several hits and still maintain its thermal image. The target should be safe to operate with respect to the auxiliary equipment (generators and batteries) as well as the supporting personnel.

In Prosser's co-pending patent application entitled "Thermal Integrated Targets" filed Sep. 10, 1990, Ser. No. 579,619, a method is disclosed for making thermally radiant targets using metal filled coatings to create a heating element or resistive coating as it is referred to in the application. The instant invention contains features that would be applicable to the same method, albeit with an arc-sprayed metal resistive coating.

SUMMARY OF THE INVENTION

The invention is a process wherein through a series of steps the surface of a structural element, which can be either flexible or rigid, is converted into an electrically resistive heating element, where the heating element has a resistive area of a defined thickness, and a pair of opposing conductive busses (or bands), also of defined thickness, located coextensive with and at opposing sides of the resistive area. The conductive busses are electrified with terminals supplied with power, and the busses serve to distribute the current uniformly along an edge over the resistive area so as to make the current flux over the resistance area as uniform as the boundaries of the resistive region permit. Both the resistive region and the pair of conductive busses are comprised of arc-sprayed metal. The resistive region has a total resistance value ($R_A$), where the resistance is a function of the volume resistivity, p, (which is linearly temperature dependent) times the length, l, of the element divided by the cross-sectional area, A, (A=width, w, times thickness, u,). The conductive busses have an associated resistance, $R_B$ and $R_{B'}$, that also is a function of the resistivity and the dimensions. The conductive busses are designed to have substantially less resistance than the resistive area ($R_B$ & $R_{B'} << R_A$). In the simplest case then, the resistive element will have a total resistance, $R_T$, that is a sum of $R_A+R_B+R_{B'}$. At a specified voltage, V, there will a current, i, calculated by dividing V by $R_T$; and a wattage, W, calculated by multiplying i times V. The heating element will have a heat flux, F, which is watts per surface area, calculated by dividing the watts by the surface area, S, where $S=1\times w$. By inspection, one can see that for a resistive element having a defined surface area, S, that at a given voltage and resistivity the wattage can be increased by making the depth, u, of arc-sprayed metal thicker (which lowers the resistance, $R_A$ & hence $R_T$), which increases the amperage, i. Having the flexibility to control the heat flux, F, is of particular utility in designing infrared emitting targets, as the military has standardized on two voltages, 110 volts and 12 volts, and the resistance of the target must be designed such that its surface heats to a specified wattage. To give the reader a perspective on the size and output of a typical heating element used for a target, a silhouette target is usually seven feet by eleven feet (S=77 sq ft), and has a wattage of 1100 watts. This is roughly 14.3 watts per sq ft. (F=W/S). Empirically it has been determined that a heating element prepared using arc-sprayed zinc must have a resistive region thickness of about 3 mils in order to produce a 12 volt target having 1100 watts. The resistivity for the arc-sprayed zinc is about 100 times higher than published resistivity values. This was an unanticipated benefit, because it would be very difficult to make a uniform coating one hundredth as thick, or 0.03 mils, which is what one would have predicted would be required for an 1100 watt resistive element. The resistivity temperature dependence helps to make the heat flux, F, more uniform because the current will tend to level out temperature perturbations in its search for the lowest resistive route.

The interdependence of wattage and the coating thickness necessitates in extreme care being given to using a spraying technique that enables fairly tight tolerances to be maintained, and robotics are used to apply the arc-spray. The coating thickness is determined by the speed the arc-sprayer traverses over the application surface, and the number of passes.

The interdependence of wattage and the coating thickness enables two or resistive regions having differing perimeters to be strung together and still have a substantially constant heat flux. For instance assume a resistive region, $R_A$, having dimensions of 5 ft wide and 7 ft long with a thickness of 3 mils is adjoining resistive region, $R_{A'}$ having dimensions of 2.5 ft wide and 7 feet long. In order for the two regions to have the same heat flux, the thickness of $R_{A'}$ would have to be 12 mils thick, or four times thicker than $R_{A'}$.

The conductive busses are formed similarly, by applying much thicker coatings of arc-sprayed metal. Stencils can be used to mask off more complex coating patterns.

The process for making a thermally radiant surface then consists of:

Measuring the area of the structural element that is to be coated.

Calculating the required total resistance of the resistive element required to attain the heat flux at a specified voltage.

Calculating the thickness of the resistive area and the conductive busses, based on empirically determined volume resistivity measurements of the arc-sprayed metal.

Masking off any patterns that would be ill affected by over spray.

Setting up the arc-sprayer to deliver a known rate of deposition in terms of thickness and adjusting the rate of traversing over the surface to deliver a thickness of arc-sprayed metal divisible by the number of passes.

Spraying the predetermined thickness of metal forming the conductive busses and the predetermined thickness of metal forming the resistive area.

DETAILED DESCRIPTION OF AN ILLUSTRATED EMBODIMENT

Figure 1:
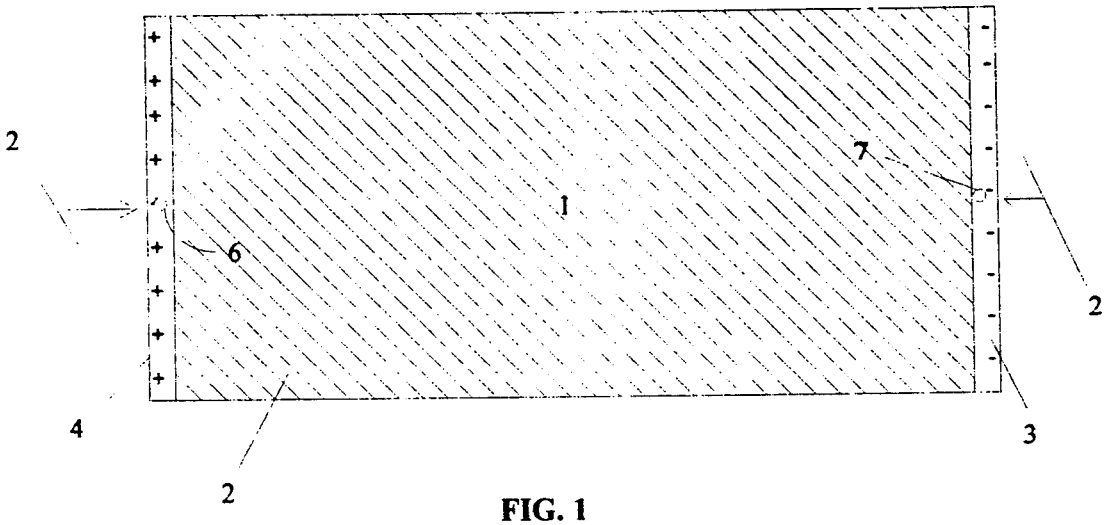
FIG. 1. Planar view of a rectangular resistive element.
Figure 2:
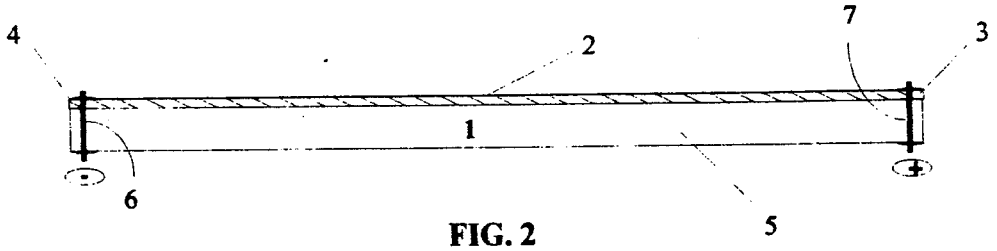
FIG. 2. Cross-sectional view of resistive element in FIG. 1 as viewed along plane defined by sectional line 2—2.

The structural element, 5, as shown in FIG. 1 and FIG. 2 is a seven by eleven foot three eight's inch thick piece of strand board, pretreated with a weather proofing coating that contains a flame retardant, on top of which has been applied a carbon filled dope and then a zinc primer which contains finely ground zinc powder. Electric terminal poles, 6 & 7, are fitted along near the both edges, where the conductive busses are to be formed. The entire surface on the primer side of the structural element is to be made thermally radiant. The heat flux, F, is to be 14.5 watts/sq. ft. for a total heat wattage of 1120 watts at 12 volts. Arc-sprayed zinc, 99.9% pure, is to be used for construction of the conductive busses and resistive area. From previous studies it has been determined that arc-sprayed zinc has a volume resistivity of $630\times10^{-6}$ ohms cm at 150 F. Based on the resistivity and the dimensions of the resistive area, 2, a resistance is calculated using Formula 1 in terms of 1 mil increments.

$$R_A = p\,l/(u\,w) \tag{1}$$

$$= \frac{0.00062 \text{ ohm} \cdot \text{cm} * 11 \text{ ft} * 12 \text{ in/ft} * 2.54 \text{ cm/in}}{1 \text{ mil} * .00254 \text{ cm/mil} * 7 \text{ ft} * 12 \text{ in/ft} * 2.54 \text{ cm/in}}$$

$$= 0.390 \text{ ohms}$$

A 1 mil resistance is 0.390 ohms, a 2 mil thickness resistance is 0.195 ohms, an a 3 mil resistance is 0.130 ohms. The current is calculated using formula 2.

$$i = V/R_{A1} \tag{2}$$

$$= 12/.390$$

$$= 30.8 \text{ amps}$$

The wattage is calculate using formula 3.

$$W = i\,V \tag{3}$$

$$= 30.8 \times 12$$

$$= 369.8 \text{ watts}$$

By inspection, one can see that a resistive coating of around 3 mils would produce the correct wattage, 1120 watts; or about three times what a 1 mil coating produces.

This same circuit analysis is applied to the conductive busses, 3 & 4. A bus 6 mils thick, 7 feet wide (the length of the resistive area width), and 1.2 inches long would have a resistance of 0.0006 ohms. Therefore $R_T$ which is equal to $R_A+R_B+R_{B'}$ would be $0.130+0.0006+0.0006=0.1312$ ohms. Current is 91.5 amps, and wattage is 1097 watts.

The arc-sprayer, at a stand off distance of 8 inches, applies a coating of zinc approximately 1 mil thick and 1.25 inches wide at a traverse rate of 1 foot per second, when the arc-sprayer amps are 35, the 1/16 inch zinc wire is fed at 2 inches/second, and the atomizing air pressure is 55 psi. Therefore, the desired rate of travel is 0.33 ft/sec to achieve a deposition depth of 3 mils for the resistive area. The conductive busses, 3 & 4, will require two passes at 0.33 ft/sec to attain 6 mils.

Coating uniformity is substantially improved through the use of mechanized spray equipment. An inexpensive, yet very functional mechanization, that affects automated spraying, is a table on a wheeled frame, which rides on a set of rails, wherein the table can be pushed or pulled at a set rate of travel, via a connecting motor-chain assembly. Spanning the table is a gantry, which bridges the table perpendicular to the rails, on which traverses a wire pulled-pushed cross-head that can be set to traverse at a set rate. On the cross-head is mounted the arc-spray nozzle and auxiliary components. The table on rails and the traversing cross-head work in concert, therein enabling arc-sprayed metal to be applied, to the upper surface of a planar element positioned on the table, applied in any horizontal direction and at a set known rate of travel. Fractious, floating atomized metal, that is generated during the spraying process, is vacuumed into a collection duct and precipitated using a water injected throttling device in combination with a cyclonic settling tank. The automated spraying equipment is isolated in a room and controlled remotely by an operator, viewing through a window, using a control panel.

The structural element, 5, is positioned on the table of the automated spraying equipment, primer side up, such that the gantry bridges the seven foot width. The room is closed off. To coat the conductive busses, the operator sets the control panel to 0.33 ft/sec rate of travel, and positions the arc-sprayer nozzle 0.75 inches inside of a width edge (w1) of the structural element and outboard of an adjoining length edge (11). The arc-sprayer is activated, and the nozzle moves on-board and parallel to w1, depositing a band of zinc 1.25 inches wide, 3 mils thick, on the surface of the structural element, and then off-board on the opposing edge (12). The arc-sprayer is cut off and moved to the opposite end, 0.75 inches inside of width edge (w2) and off-board of the length edge (12), where the coating process is duplicated. To coat the resistive area, 2, and add another 3 mils of zinc to the conductive busses, the control panel of the automated spraying equipment is set up such that the table will traverse back and forth, through a distance substantially equal to the length of the structural element, and the cross-head will increment 1.125 inches after each pass, therein applying total coverage to the surface of the structural element. Each band of spray will overlap the adjoining band, deposited in the preceding pass, by 0.125 inches. This overlap is required to account for the feathering on the perimeter of the spray pattern. The spraying is started from one corner.

To protect the coating, the front and rear surfaces of the structural element, which is now fitted with a thermal radiant front surface, 1, is coated with a flame proof brominated epoxy resin and then painted.

Figure 3:
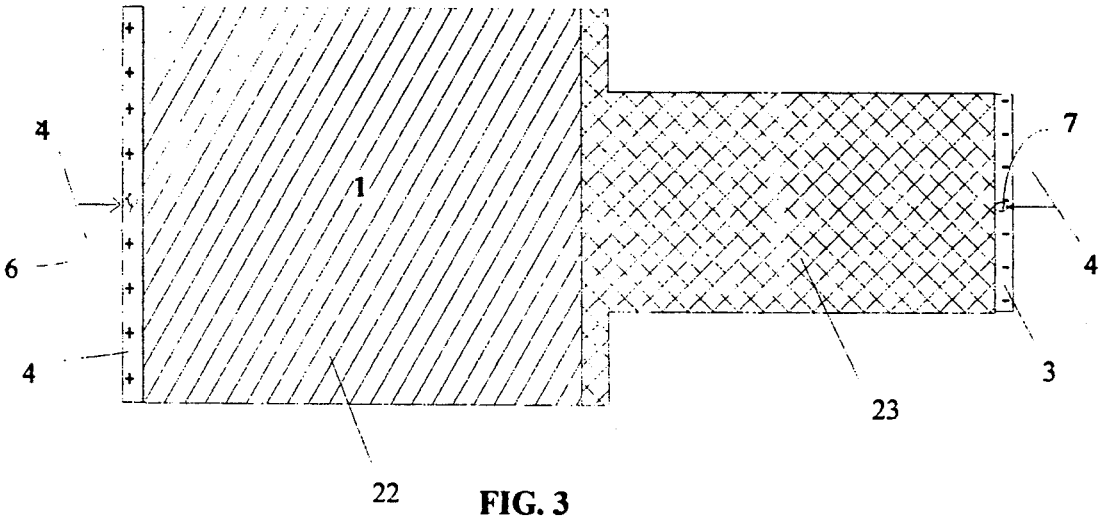
FIG. 3. Plan view of a compound rectangular resistive element.
Figure 4:
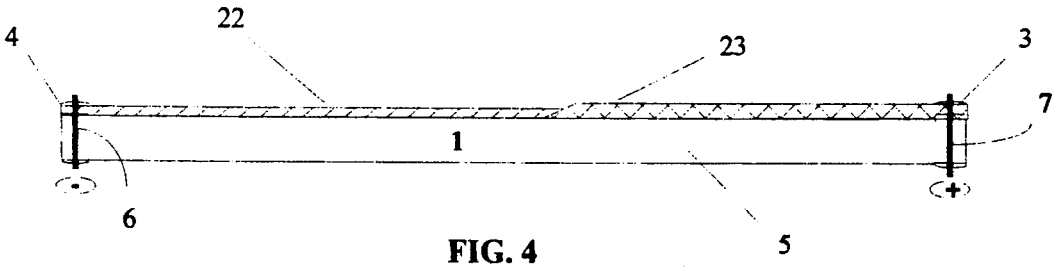
FIG. 4. Cross-sectional view of compound resistive element in FIG. 2 as viewed along plane defined by sectional line 4—4.

FIG. 3 and FIG. 4 depict as slightly more complex electrically resistive element, 1, comprised of a resistive area 2 having two resistive sub-areas 22 and 23, where the sub-areas are of different surface area, S, and thickness, u. Sub-area 22 is 7 feet wide and 7.5 feet long and is 3 mils thick, $u_1$. Sub-area 23 is 3.5 feet wide and also 7.5 feet long, of an unspecified thickness, $u_2$. It is desired that sub-area 22 and 23 have the same watt/sq ft, that is that their surface would be the same temperature when viewed by an infrared detector. From formula 1, the resistance of sub-area 22 is calculated to be 0.088 ohms and have a surface area, S, of 52.5 sq ft. The surface of sub-area 23 at 26.25 is only half of sub-area 22. Therefore, sub-area 22 must have a wattage that twice sub-are 23, in order to have the same heat flux, F, (watts/sq ft). Since sub-area 22 and 23 are in series, they will have the same current. Therefore, in order for there to be twice the wattage in 22, twice as much voltage will have to be expended. From formula 2, we know that in order to have twice the voltage expended, then the resistance is twice as high. Stated alternatively the resistance of sub-area 23 is half of sub-area area 22 which is 0.089 ohms. Half of 0.088 ohms is 0.044 ohms. The thickness of sub-area 23 is solved for, using formula 1, and is found to be 12 mils. The total resistive area is area S is $52.5+26.25=78.75$ sq ft. The total resistance is 0.0132 ohms, neglecting the busses which are negligible, and the total is wattage of 1081.5 watts, with sub-area 22 and 23 each having a heat flux of 13.7 watts/sq ft.

The automatic spray equipment would be set up to build up the thickness of sub-area 23, 9 mils thicker than sub-area 22.

What is claimed is:

1. A process for forming an electrically resistive element onto a surface of a structural element, using arc-sprayed metal, to produce a new surface, wherein the new surface is thermally radiant when, in the conveyance of an electric current, the electrically resistive element produces heat, wherein the process consists of the following steps:

Measuring an area of the surface of the structural element on to which is to be formed the electrically resistive element, wherein the electrically resistive element on the structural element is sized so as to simulate a military target having a distinctive signature infrared image;

Calculating a set of design parameters for a total resistance of the electrically resistive element to produce a heat flux of greater than or equal to 13.7 watts per square foot, where the resistive element is comprised of a resistive area having a surface that is not less than a bounded width of 18.9 inches and a bounded length of 34.5 inches and a pair of conductive busses, wherein both the resistive area and the pair of conductive busses are formed using a single arc-sprayed metal;

Using the set of design parameters to determine a total coating thickness of arc-sprayed metal of the resistive area and a total coating thickness of arc-sprayed metal of the conductive busses;

Confirming that the total coating thickness of arc-sprayed metal of the resistive area is within lower coating limits of equipment, wherein a practical lower limit for coating thickness of arc-sprayed metal is 0.1 mil;

Masking off sections of the structural element;

Setting an automated arc-sprayer to deliver a rate of deposition of metal at a rate of travel, and adjusting the rate of travel over the surface of the structural element such that for each pass over the surface of the structural element a fractional thickness of arc-sprayed metal is deposited, wherein the total coating thickness of arc-sprayed metal is a cumulative total of fractional thicknesses denominated by a sum of the number of passes;

Spraying the total coating thickness of arc-sprayed metal forming the conductive busses and the total coating thickness of arc-sprayed metal forming the resistive area, wherein the combination of multiple passes of the arc-sprayer enables a continuous coating of a single metal to be applied onto a structural element.

2. The process as claimed in claim 1 where the arc-sprayed metal is zinc.

3. The process as claimed in claim 1 where the process is used in combination with one or more other known heat producing techniques.

4. The process as claimed in claim 1, where the resistive area is a total resistive area comprised of a combination of two or more smaller resistive areas in one electrical circuit.

5. The process as claimed in claim 1, wherein the arc-sprayed metal is applied using an automated apparatus, comprised of a planarly traversing coating means and a controlling means for remotely controlling the coating means.

* * * * *